United States Patent [19]

Calamani et al.

[11] 4,044,962

[45] Aug. 30, 1977

[54] APPARATUS FOR YARN STORING AND FEEDING TO YARN USING MACHINES

[76] Inventors: Sergio Calamani, via Settima, 27-Segrate San Felice; Eugenio Turri, via Benedetto Marcello 1-; Ermanno Savio, via Garofalo 22-, all of Milan, Italy

[21] Appl. No.: 565,607

[22] Filed: Apr. 7, 1975

[51] Int. Cl.[2] ..... B65H 51/24

[52] U.S. Cl. ..... 242/47.05; 242/47.01; 242/47.12

[58] Field of Search ..... 242/47.05, 47.04, 47.01, 242/47.12, 47.13

[56] References Cited

U.S. PATENT DOCUMENTS

| | | | |
|---|---|---|---|
| 2,424,489 | 7/1947 | Moritz | 242/47.05 |
| 2,492,055 | 12/1949 | Moritz | 242/47.05 |
| 2,649,645 | 8/1953 | Cole | 242/47.05 |
| 3,709,444 | 1/1973 | Tannert | 242/47.04 |
| 3,776,480 | 12/1973 | Lawson | 242/47.12 X |
| 3,796,386 | 3/1974 | Tannert | 242/47.05 X |
| 3,822,833 | 7/1974 | Fecker | 242/47.12 |

*Primary Examiner*—Stanley N. Gilreath

[57] ABSTRACT

Apparatus for storing yarn drawn off from a spool or cop and feeding such yarn with a controlled tension to a textile machine. The apparatus comprises a drum on which a rotating arm distributes yarn windings that are displaced from one to the other end of the drum by a device including groups of swinging blades alternatively projecting and upwardly moving through slits in the drum. These blades keep the yarn windings separated from one another during translation on the drum, each of the windings being arranged between two successive blades in each group.

1 Claim, 5 Drawing Figures

FIG. 1
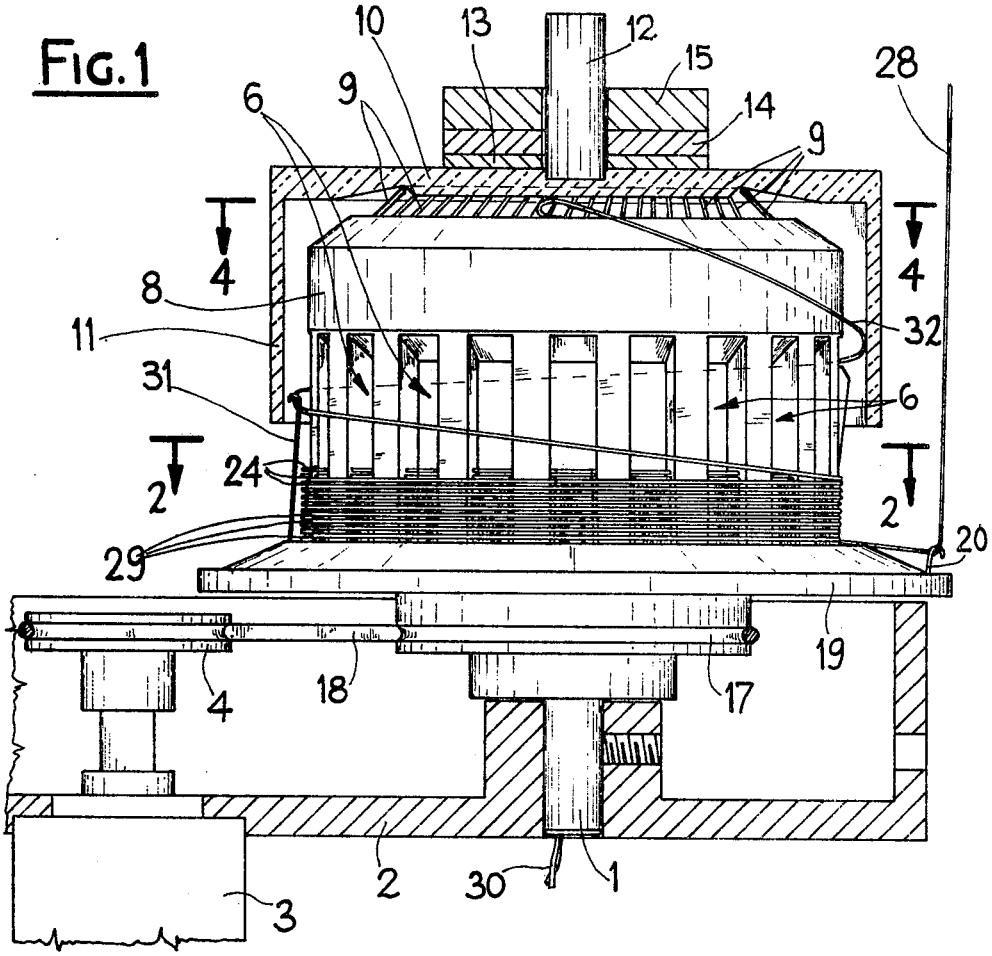
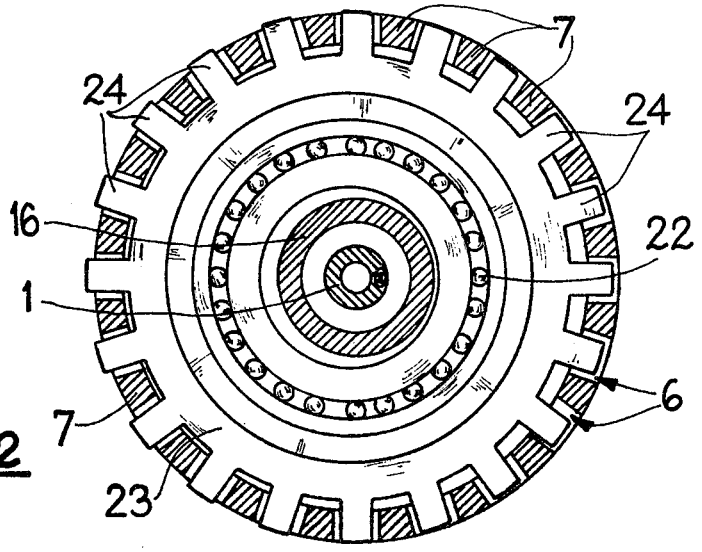
FIG. 2

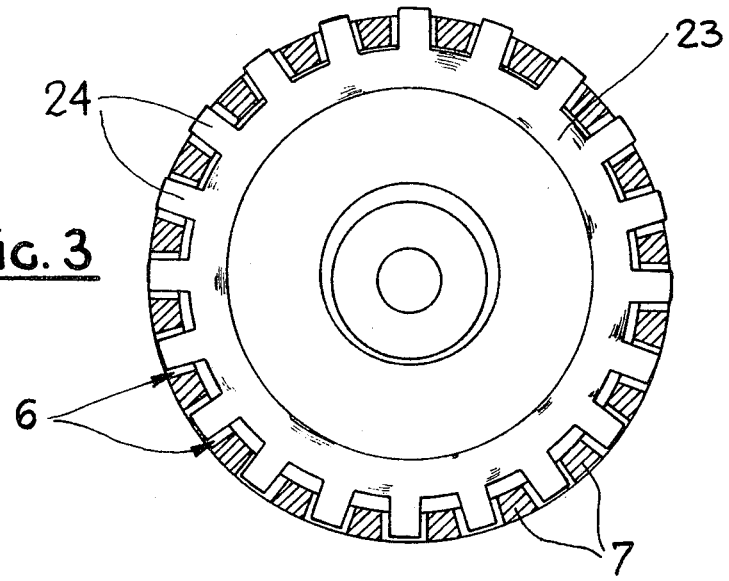
FIG. 3
FIG. 4
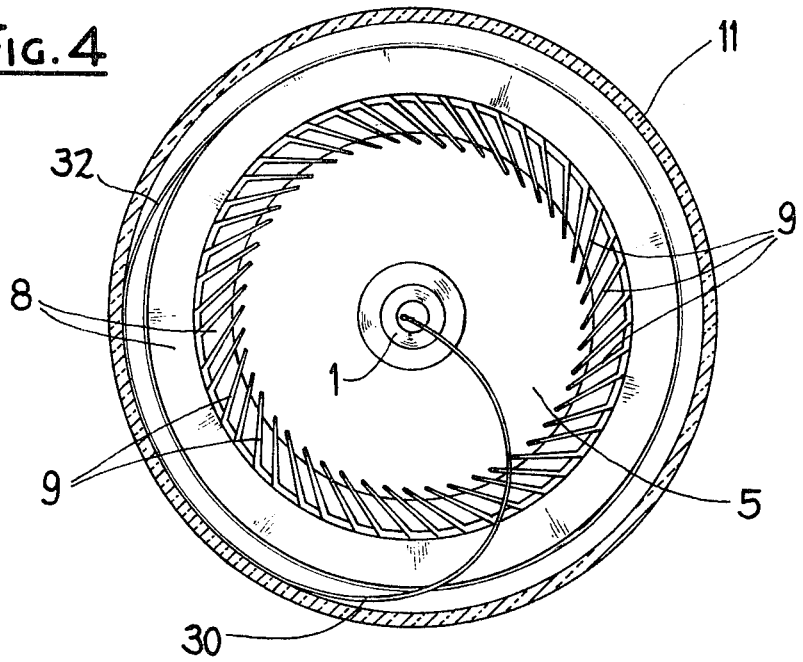

APPARATUS FOR YARN STORING AND FEEDING TO YARN USING MACHINES

FIELD OF THE INVENTION

This invention relates to an apparatus for storing and feeding yarn to yarn utilization machines, such as looms, knitting machines and the like, and more particularly to with a device for forwardly moving yarn windings wound on the apparatus.

BACKGROUND

As is well known, many machines, such as looms, are not directly supplied with yarn from a bobbin, cop, spool or the like, but from a spool such a yarn reaches the utilization machine after being previously wound up on an apparatus, thereat forming a magazine or supply of yarn, which is then supplied to the utilization machine with a constant controlled tension, or at constant rates.

The prior art apparatus comprises a drum, to one end of which yarn windings are wound, the yarn being drawn off from the other end of the drum. Rigid oscillating mechanical members are then provided and are effective on the yarn windings wound up on the drum, causing the translation at that end of the drum, whereat they are supplied, to the other end where the yarn is drawn off. In some apparatus, such as those disclosed in German Pat. No. 2,301,416, U.S. Pat. No. 3,796,386, French Pat. No. 1,285,954 or corresponding German Pat. No. 1,191,197, the yarn is drawn off through a hole or bore centrally of the drum, on which the windings are wound.

Mechanical members of different nature are known for translating the yarn windings along the outer surface of the drum. According to the disclosure in the above mentioned patents, U.S. Pat. Nos. 3,419,225 and 2,625,340 and still many other patents, adjacent that end of the drum where the yarn is wound, provision is made for a disc or plate oscillating with respect to the drum, this plate having an arc on its surface which is always in contact with a length or section of the winding closest thereto.

The plate oscillates about an axis inclined relative to the drum axis, so that the contacting zone between the plate and yarn winding adjacent thereto will continuously vary throughout the drum periphery. Thus, the plate urges or pushes the winding ahead, leaving a free space wherein another winding is continuously distributed. The winding being pushed away by the plate, in turn pushes away the winding adjacent thereto, the latter pushing away the next winding and so on, causing a simultaneous displacement of the entire package of windings wound up on the drum.

This winding translation system suffers from serious disadvantages consisting, for example, in that with particular yarns the windings tend to overlap, the windings tend to bind against one another should the yarn be of pile nature, and that, should the yarn break at any location, the windings loosen and overlap, making it difficult to find the free end of the broken yarn.

Other systems are also known for yarn displacement on the drum, such as that disclosed in U.S. Pat. No. 1,052,212, wherein the apparatus comprises two sets of circumferential bars and members for radially and axially moving each set of bars relative to the other set, so that each set of bars alternately picks up the yarn wound up about the sets of bars, axially displaces the yarn and lets it go on the other set of bars. Also this yarn winding displacement system has disadvantages consisting, for example, in that the windings tend to freely drop or fall down and overlap (which is avoided by imparting a high tension to the incoming yarn on the apparatus), there is no control on the position of the yarn windings and also, should the yarn break, the windings tend to drop or fall down and it is difficult to find the free end of the broken yarn.

SUMMARY OF THE INVENTION

It is the primary object of the present invention to provide a yarn storing and distributing or dispensing apparatus which is provided with a device for displacing or moving on a drum, forming part of the apparatus, yarn windings wound thereon, keeping such windings spaced apart from one another and avoiding any overlapping thereof even in case of yarn breakage.

These and still other objects are accomplished by an apparatus comprising a drum which, at least partly, is substantially cylindrical, having a plurality of longitudinal slits distributed throughout its periphery, an arm fitted with members for hooking the yarn from a spool and dispensing or distributing it as windings on said drum adjacent one end thereof, a drive or control member for imparting a relative rotational motion between said arm and drum, and a swinging device for translating the yarn windings from the one end of the drum where they are laid by the arm to the other end of said drum, where the yarn is drawn off and supplied to a yarn using machine. The invention apparatus is characterized in that there extends in the drum a shaft carrying the arm and at least one rolling bearing, the axis of which is inclined to and eccentric with respect to the drum axis, and in turn the bearing carries an annular body having at its periphery a plurality of outwardly radially projecting blades distributed in groups superposed on and spaced apart from one another, one group of said blades being positioned and swingable in each distinct longitudinal slit of the drum.

BRIEF DESCRIPTION OF THE DRAWING

In order that the structure and features of the device will become more clearly understood, an exemplary embodiment thereof will now be described with reference to the accompanying drawings, in which:

FIG. 1 is a side elevational view, partly cut away, of the inventive apparatus;

FIGS. 2 and 3 are sectional views of the apparatus, as taken along line 2—2 of FIG. 1, FIG. 3 schematically showing the rotating portion of the apparatus rotated by 90° relative to said FIG. 2;

FIG. 4 is a sectional view of the apparatus, as taken along line 4—4 in FIG. 1.

DETAILED DESCRIPTION

Figure 5:
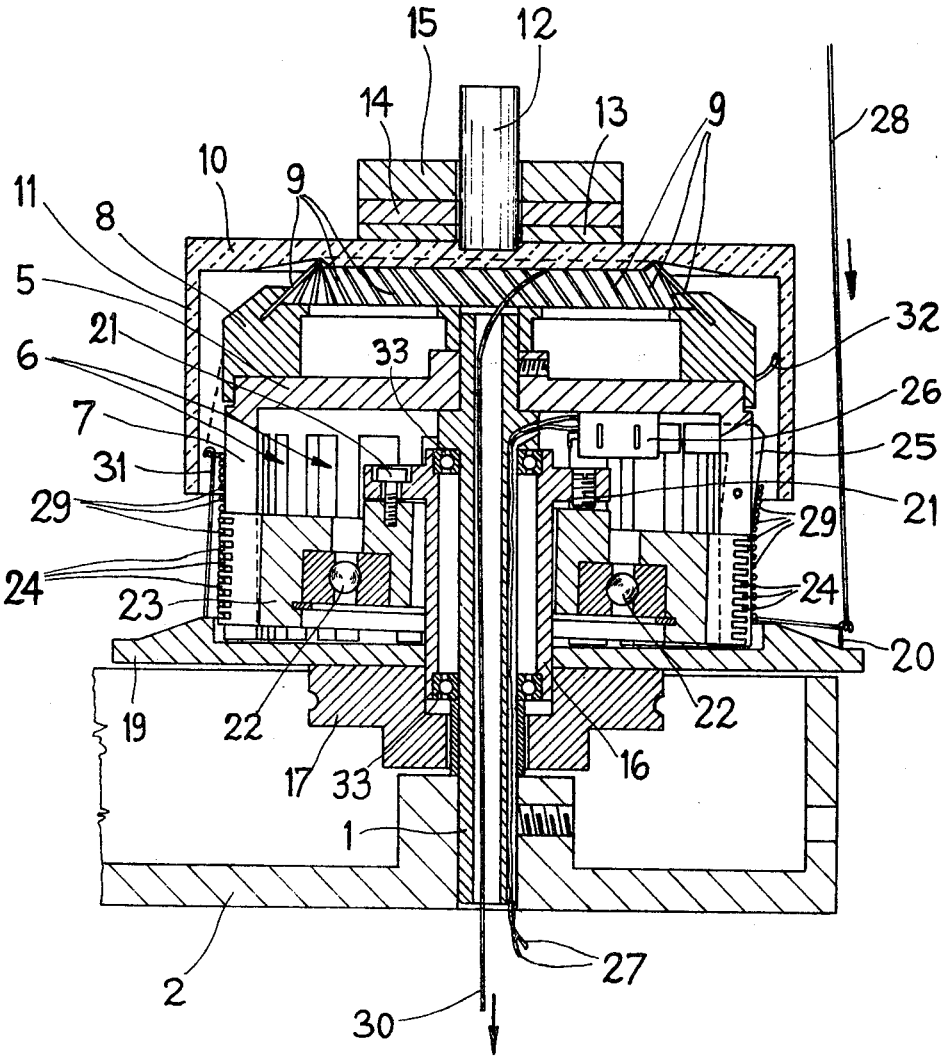
FIG. 5 is an axial sectional view of the apparatus.

As it will be seen in the figures of the drawings, the apparatus according to the invention comprises an upright hollow shaft 1 fast with a bracket 2, the latter having fast therewith an electric motor 3 provided with a driving pulley 4. The upper end of shaft 1 has a drum fast therewith, as formed by a plate 5 and a substantially cylindrical peripheral wall surrounding shaft 1. This peripheral wall has a plurality of longitudinal slits 6 formed therein defining longitudinal rods 7. Above said plate 5, a plate 8 is positioned (having, as plate 5, a central hole coaxial with the hole or bore of shaft 1), therefrom the projecting a plurality of flexible elongate thin fingers 9, made of plastic material and distributed on a conical surface (FIGS. 1 and 5) and inclined (FIG. 4) in the movement direction of the yarn running off from the apparatus.

Above the drum, a bell is positioned, having a base wall 10 and a cylindrical peripheral wall 11 spaced from the outer surface of the drum. On the underside of bell wall 10 a shaped annular groove is formed in which, when the bell overlies the drum, the free ends of fingers 9 are accomodated, thus supporting the bell and preventing side movements thereof (this due to the provision of said shaped groove).

A peg or spoke 12 projects from the upper surface of bell wall 10, on which one or more perforated metal discs can be slipped and on which, in the embodiment of FIGS. 1 and 5, three have been shown, designated by reference numerals 13, 14 and 15, of a different thickness and accordingly of different weight.

By means of two bearings 33 clearly shown in FIG. 5, the shaft 1 has a bush or sleeve 16 mounted thereon with a pulley 17 fast therewith and driving connected to drive pulley 4 by means of a belt 18 (FIG. 1). A rotating arm comprising a pan 19 with a hook 20 projecting therefrom secured sleeve 16.

The sleeve 16 carries a rolling bearing 22 through screws 21, permitting adjustment of the slope or inclination of bearing 22 whose axis is accordingly inclined relative to the axis of shaft 1 (FIG. 5). As particularly shown in FIG. 2, the axis of bearing 22 is also laterally displaced relative to the axis of shaft 1, so that, as the bush or sleeve 16 rotates, bearing 22 will swing about shaft 1, as shown also by a comparison of FIGS. 2 and 3, in which the bush or sleeve is shown at two positions angularly rotated by 90° to each other.

Bearing 22 carries an annular body 23, at the periphery of which a plurality of blades 24 project radially outwards and are distributed in groups wherein the blades are superimposed on and spaced from one another. In the apparatus, a group of blades 24 is provided at each separate slit 6 of the drum, the sizing of the blades, as well as the eccentricity and slope of bearing 22, being such that at any position or at any time only those blades, that are positioned at a restricted sector of the drum, will project beyond the outer surface of rods 7, this sector being angularly displayed throughout the drum circumference during rotation of bush or sleeve 16.

Accordingly, as readily apparent, during rotation of the bush or sleeve 16, each of the group of blader will radially translate outwardly of the surface of rods 7 and move from bottom to top, followed by a displacement movement inwardly of the drum with a downward displacement movement. As the bush or sleeve 16 rotates, this motion is continuously repeated for each of the group of bladers.

Finally, it will be seen from FIG. 5 that a rocking lever 25 is mounted at one of said slits 6 and projects outwardly of the drum, and lever 25 has a portion thereof adjacent a microswitch 26 internally of the drum and connected to motor 3 by wires 27: thus, depending on the position being taken, the lever 25 can effect either stoppage or operation of motor 3.

In FIGS. 1 and 5, reference numeral 28 designates a section or length of yarn from a spool (not shown), and reference numerals 29 and 30 respectively designate the yarn windings wound about the drum and a section or length of yarn being supplied from the apparatus to utilization machine (not shown).

During operation of the apparatus, arm 19 rotates with pulley 17 and hook 20 therewith, the latter drawing the yarn from the spool and winding it about the rods 7 adjacent the lower end thereof. Blades 24 are inserted between each winding and those adjacent thereto, causing the same to move upwardly by sliding on the outer surface of rods 7. The blades keep the windings separated from one another, which is highly important, since this prevents the windings from overlapping, avoids the risk that a winding might bind against adjacent windings should the yarn be a pile type of yarn, and prevents the windings from dropping or falling down should the yarn break: this condition is shown in FIG. 1.

If desired, it is apparent that above the zone where the blades 24 can arrive, that is at the top of the drum, there can be formed a reserve or supply of yarn windings contacting one another and urged against one another (in which case the outer surface of the drum may be slightly conical or tapered with (the apex facing upward), should this be allowed by the nature of the yarn: this condition is shown in FIG. 5.

The yarn drawn off by the utilization machine passes through the bore of shaft 1 and runs off at a high speed from the upper end of the drum, forming a balloon (designated by reference numeral 32 in FIGS. 1, 4 and 5); which balloon is accomodated within the bell. The yarn passes between the underside of bell wall 10 and the free end of fingers 9, deflecting the latter one at a time. The braking effect of such fingers on the yarn is proportional to the overall weight of the bell and discs 13, 14 and 15 weighing thereon; Since it is very easy to vary the number of the discs, as well as the individual and overall weight thereof, it is a very simple matter to adjust, within very wide ranges, the braking effect of said fingers 9.

As apparent, the finger 59 could be integral with the bell and have the free ends thereof bearing on the drum plate 8, and the discs could be of a shape other than that shown and be restrained to the bell otherwise than by means of the peg or spoke 12.

When an undue amount of yarn windings is built up on the drum, such windings will act upon lever 25 causing the operation of microswitch 26 and stopping the motor 3, as a result.

On the other hand, when the number of windings wound on the drum is too low, lever 25 will swing in the opposite direction causing motor 3 to be started.

The apparatus as described is suitable to feed either continuously or intermittently yarn with a constant tension to a utilization machine. Instead, when desiring to supply the same machine with constant lengths of yarn in a given time, it suffices to apply a hook 31 to the pan 19 (this hook could also be always provided fast with the pan along with hook 20), extending to the upper end of the drum (FIGS. 1 and 5). The yarn exiting from the drum (shown in broken lines in FIGS. 1 and 5) is drawn off by the hook 31 and directly supplied below the bell and then to the bore or hollow of shaft 1. Since pan 19 rotates with a constant speed, and both hook 20 and hook 31 are fast or integral therewith, as a result, as much yarn is wound on the drum as the yarn is being drawn off therefrom, making unnecessary the provision of microswitch 26 and the members associated therewith.

Thus, it can be readily understood that the disclosed apparatus can be used under any practical condition, applicable to any textile machine and suitable to deal with any type of yarn.

Although a particular embodiment of an apparatus for storing and dispensing yarn to yarn utilization machines has been particularly described, it is apparent that the structure of the apparatus may be quite different from that shown in the drawings, since the present invention is related only to the device for translating the yarn windings on the apparatus drum.

What we claim is:

1. An apparatus for storing and feeding yarn to a yarn utilization machine, comprising: a drum which, at least partly, is substantially cylindrical, said drum having a plurality of longitudinal slits distributed throughout its periphery; an arm fitted with members for hooking yarn from a spool and dispensing or distributing it as windings on said drum adjacent one end thereof; drive means for imparting relative rotational motion between said arm and said drum; and a swinging device for translating the windings from said one end of the drum where they are laid by said arm to the other end of said drum, where the yarn is drawn off and supplied to the yarn utilization machine; said swinging device including a shaft extending in said drum and secured therewith, a first bearing on said shaft, a bush mounted on said first bearing and coupled to said drive means for undergoing rotation relative to said shaft, said arm being fixed to said bush, a second roller bearing having an axis inclined to and eccentric with respect to the drum axis; an annular body mounted on said second bearing and including a plurality of superimposed and spaced blades projecting radially outwardly from its periphery, said blades being distributed in groups positioned and swingable in respective slits in the drum, and means tiltably carrying said second bearing from said bush and including leveling screws between said bush and said second bearing for adjusting the inclination of said second bearing, said annular body and said blades with respect to said drum.

* * * * *